US005979941A

United States Patent [19]

Mosher, Jr. et al.

[11] Patent Number: 5,979,941

[45] Date of Patent: Nov. 9, 1999

[54] LINKAGE IDENTIFICATION SYSTEM

[76] Inventors: Walter W. Mosher, Jr., 7623 Southby Dr., West Hills, Calif. 91304; Reuel S Orocio, 869 N. Fifth Ave., Covina, Calif. 91730

[21] Appl. No.: 08/972,304

[22] Filed: Nov. 18, 1997

Related U.S. Application Data

[60] Provisional application No. 60/031,365, Nov. 19, 1996.

[51] Int. Cl.[6] ..... B42D 15/00

[52] U.S. Cl. ..... 283/67; 40/633; 235/378; 235/462; 283/70; 283/75; 283/77; 283/900

[58] Field of Search ..... 283/70, 75, 74, 283/77, 67, 900; 40/633; 235/375, 378, 383–385, 462

[56] References Cited

U.S. PATENT DOCUMENTS

| | | | |
|---|---|---|---|
| 3,556,563 | 1/1971 | Scheinberg et al. | 283/67 |
| 3,848,112 | 11/1974 | Weichselbaum et al. | 235/61.7 R |
| 4,164,320 | 8/1979 | Irazoqui et al. | 235/382 |
| 4,476,381 | 10/1984 | Rubin | 235/375 |
| 5,243,173 | 9/1993 | Dunn | 235/375 |
| 5,381,487 | 1/1995 | Shamos | 382/2 |
| 5,505,494 | 4/1996 | Belluci et al. | 283/72 |
| 5,531,482 | 7/1996 | Blank | 283/67 |
| 5,627,356 | 5/1997 | Takemoto et al. | 235/381 |
| 5,635,012 | 6/1997 | Belluci et al. | 283/70 |
| 5,653,472 | 8/1997 | Huddleston et al. | 283/75 |

*Primary Examiner*—Andrea L. Pitts
*Assistant Examiner*—Monica Smith
*Attorney, Agent, or Firm*—Thomas P. Mahoney

[57] ABSTRACT

An identification and information system for establishing a nexus between discrete entities includes primary and secondary information regarding primary and secondary entities borne by primary and secondary information means. The primary and secondary information may be encoded for mechanical reading which establishes the nexus between said primary and secondary entities.

11 Claims, 2 Drawing Sheets

LINKAGE IDENTIFICATION SYSTEM

This application claims the benefit of U.S. Provisional patent application Ser. No. 60/031,365 filed Nov. 19, 1996.

This invention relates to an entity nexus and linkage information system and method of identification wherein the identity of one entity or individual is established by a nexus with another entity or individual and to the method of utilization of the components of the system provided by the invention and to the individual components of the system.

BACKGROUND OF THE INVENTION

Identification cards, such as credit cards, driver's licenses, and similar identifying instruments, have employed a variety of means to avoid counterfeiting and to properly identify an individual involved in a particular transaction. In order to avoid the use of such identification cards by individuals who are not legitimate cardholders, an image, frequently in color, of the cardholder is applied to the card or other instrument to permit the recognition of the legitimate owner of the card or other instrument at the time that the card is utilized to identify the legitimate owner of the card.

Such images are generally made by video imaging input to a computer. The image may, thereafter, be placed on a card or other instrument having descriptive text printed thereupon by a selected conventional process. More recently, as the art of symbology has advanced, it has been suggested that symbol technology comprising characteristic parameters of the image of the cardholder be stored on the identification card in proximity to the image, U.S. Pat. No. 5,505,494.

This permits the identification of the cardholder to be verified by scanning or viewing the image of the cardholder, thereby re-determining the characteristic parameters of the cardholder and comparing the same with the parameters of the corresponding symbology on the card. Therefore, the alteration of the card by the substitution of an image other than the original image is ineffective because of the subsequent comparison of the substituted image with the original symbology.

Also exemplary of such a prior art identification card is that disclosed in U.S. Pat. No. 4,179,686, entitled "System for Checking the Authenticity of Identification Paper" issued Dec. 8, 1979.

The symbology is created by scanning the image or by utilizing video and computer technology to record the image of the cardholder or the actual image presented when the cardholder applies for the issuance of the card. In substitution for or in addition to the symbology mentioned above, an RFID (radio frequency identification) circuit can be utilized. Such identification means are related to a particular card or document holder bearing the image and the encoded corresponding symbology which will approximately reproduce the image.

SUMMARY OF THE INVENTION

This invention relates to a nexus establishing linkage identification system which can be utilized, for instance, to establish the parental relationship between an adult, the primary entity, and a child, the secondary entity, by providing the adult and child with primary and secondary information means bearing a representation of the adult and/or child, respectively, and encoded information which establishes the fact that the child is, indeed, the child of the person who is claiming the parental relationship.

The terms "nexus" or "linkage" are utilized in this disclosure to broadly establish the parameters of the invention in that it can be used to provide proof of various relationships such as parent and child, document and individual, and various other relationships wherein it is desirable to establish a nexus between individuals, individuals and objects, or objects and objects.

In order to accomplish the desired end of establishing such relationships, we provide nexus or linkage relationship kits which incorporate components necessary to establish the relationship between primary and secondary individuals or entities, such as an individual and certain subject matters, a relationship between certain subject matters and other subject matters, and the like.

It is, therefore, an object of our invention to provide a nexus establishing kit which incorporates, as a means of establishing such a relationship, a primary identification card or badge; and a secondary identification means which can be in the form of an identification bracelet wherein the manner of establishing the nexus involves a child or inanimate components or animals or the like.

For instance, incorporated in the kit in conjunction with the identification card or badge can be an identification wristband which is placed upon the wrist of, for instance, a child or an incompetent adult or the like in order to permit the owner of the card to establish the parental or other relationship with the child or adult which needs to be established in order that the cardholder may exercise parental or other rights in respect to the individual utilizing the wristband.

Another object of the invention is the provision of a kit of the aforementioned character wherein the respective card and wristband components are provided with adhesive backing which is covered by a protective covering to permit the functioning of the card and wristband in a conventional manner. A further object of the invention is the provision of a kit of the aforementioned character wherein the card and wristband are incorporated in a single sheet of material and wherein scorelines are provided about the perimeter of the card and wristband to permit them to be respectively stripped from the carrier sheet.

An additional object of the invention is the provision of a linkage identification kit which incorporates additional materials such as seriatim tickets which permit the wearer of the wristband and the owner of the card to participate in various amusement facilities, as at an amusement park.

A further object of the invention is the provision of an identification card which includes a photographic or other image of the individual utilizing the card in conjunction with an encoded representation of the photograph on the face of the card in juxtaposition to the image.

If desired, the encoded material can be carried over from the face to the back of the card should the symbology utilized be so bulky as to not be accommodated on the face of the card in juxtaposition to the image or other representation of the cardholder.

An additional object of the invention is the provision of a card of the aforementioned character which is intended to establish the identity of the cardholder and which includes, as mentioned hereinabove, a photographic or other image of the cardholder together with an encoded symbology of the photograph or other representation wherein the encoded materials provide a different view of the cardholder from that provided in a photographic or other image.

For instance, a full-face image of the cardholder can be provided on the face of the card and an image, perhaps a side view, can be incorporated into the encoded material. Thus, a more comprehensive representation of the cardholder can be achieved in accordance with the identification standard established in police and other identification methods.

A further object of the invention is the provision of a wristband wherein said band incorporates a photographic or other representation of the person wearing the wristband together with encoded images which represent the cardholder or other image or information and which are comparable by the use of suitable readers to establish the identity and relationship of the individual wearing the wristband.

Another object of the invention is a method of establishing a nexus between primary and secondary entities by the use of primary and secondary information means having primary and secondary information.

Other objects and advantages of the invention will be apparent from the following specification and the accompanying drawings.

PREFERRED EMBODIMENT OF THE INVENTION

Figure 1:
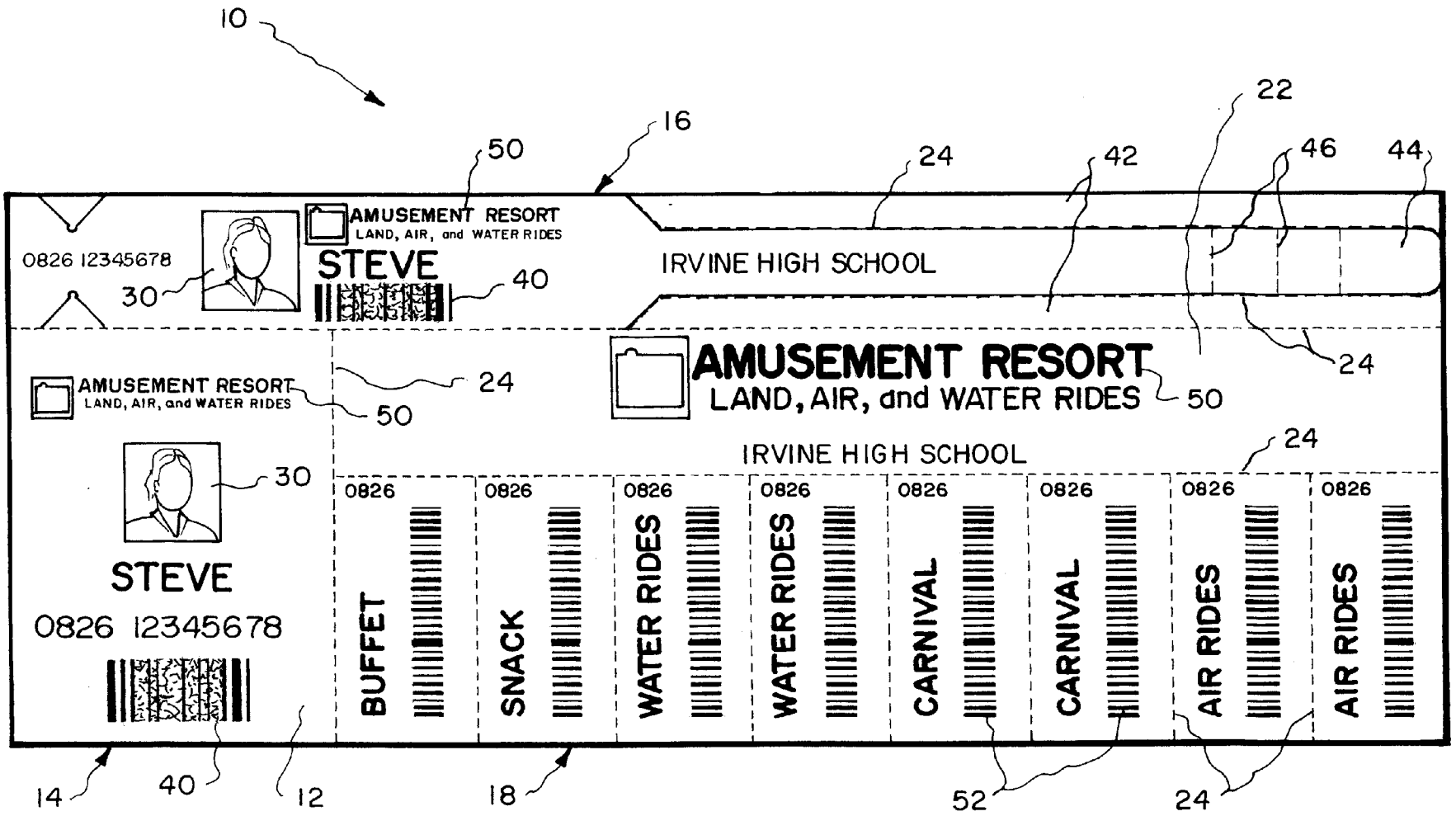
FIG. 1 is an exemplar of the identification linkage kit incorporating the teachings of the invention.

Referring to the drawings, and particularly to FIG. 1 thereof, we show a nexus or linkage identification or information kit 10 which is of generally rectangular configuration and which may be printed by conventional printing means or other more sophisticated means of establishing communicable material on a receptive surface. The substrate 12 from which the kit 10 is fabricated can include plastics, such as polyethylene, polypropylene, polycarbonate, cellulose acetate, or alternatively, may comprise paper, paper coated with a resin or pigment, such as calcium carbonate or calcine clay or synthetic paper, such as Tyveke®, manufactured by Dupont.

Imprinted on the surface of, for instance, the paper from which the kit 10 is formed are the various components of the kit 10. In the present embodiment of the invention, these include a primary identification card or badge 14, a secondary identification wristband 16, a plurality of amusement ride tickets 18, and a centrally-located identification panel 22 which indicates the locus with which the various other elements of the identification kit 10 are associated.

The individual elements of the kit 10, including the card or badge 14, the identification wristband 16, and ride tickets 18 have scored perimeters 24 which permit the separation of the various components of the kit from one another. The back of the kit is coated with pressure-sensitive adhesive and includes a paper cover which can be stripped from the respective elements of the kit in a manner to be described in greater detail below.

In utilizing the particular kit under consideration, the identification card or badge 14 is separated from the remainder of the kit 10 by utilization of the scorelines 24 and the paper backing is stripped from the pressure-sensitive adhesive on the back of the card or badge. This card or badge may be applied directly to the clothing of the individual whose image 30 is displayed on the front of the badge. If it is desired that the portion 14 of the kit be utilized as a card, the backing paper material is not removed from the pressure-sensitive adhesive to facilitate the handling thereof. It should be understood that certain portions of the backing material may not be removable from certain of the elements of the kit 10.

The visually perceptible primary informational image 30 on the card or badge 14 may be a photographic image or may be computer or otherwise generated and provides an immediate perception of the identity of the individual presenting the card or badge for its intended purpose.

However, it is well known that the state-of-the-art permits facile substitution of images on cards or other identification means and, therefore, we provide secondary informational encoded symbology 40 juxtaposed to the visual image 30.

Therefore, when the card is presented for identification, it may be inserted in a reader, not shown, which will analyze the symbology 40 and result in the recreation of an image which is recognizably similar but not necessarily identical to the visual image on the card.

The symbology or code 40 may be utilized in various forms; for instance, in the form of the PDF 417 bar code symbology provided by Symbol Technologies of Bohemia, New York. Equivalent encoding means include bar codes, magnetic tapes, and a wide variety of equivalent means for incorporating condensed information. In addition to an image of the cardholder, other images and information such as a fingerprint may be included in the symbology. In addition to the symbology already mentioned, an RF chip or other circuit means may be incorporated in selected elements of the kit 10.

It will be noted that the image 30 is also found on the identification wristband 16 together with the symbology 40.

Image 30, as it appears on the card 14 and the identification wristband 16, is identical. Different images can be provided on the card 14 and identification wristband 16 for purposes which will be discussed in greater detail below.

In the present application of the linkage kit 10, the primary individual utilizing the tickets 18 is the identity to be established and the nexus is through the wristband 16 and tickets 18 themselves. Although the tickets 18 show the use of the wristband 16 and the bar code to establish the secondary information relating to the individual, it should be understood that any type of encoding can be utilized, including an RF chip or equivalent circuitry.

In using the linkage kit 10, the card 14, wristband 16, and ticket strip 18 are separated from one another. As previously explained, the decision as to what manner the card 14 should be used determines whether the backing on the pressure-sensitive adhesive on the card 14 should be exposed to permit the use of the card 14 as a badge by adherence to the clothing of the individual utilizing the card. However, when the identification wristband is separated from the other components of the kit 10, the band is additionally separated from the remainder 42 of the kit. At this juncture, it should be pointed out that the protective release paper covering (not shown) of the back of the kit 10 is correspondingly scored to the scoring 24 on the face of the kit so that the release paper may be correspondingly separated with the individual components of the kit 10.

After the separation of the wristband 16 and its further separation from the residuum 42 of the kit 10, the wristband 16 is placed about the wrist of the holder of the tickets 18 and the card or badge 14. The back of the wristband at one extremity 44 has the protective release paper segmented by additional scoring 46 which permits the pressure-sensitive adhesive on the back of the wristband 16 to be exposed as necessitated by the size of the wrist of the person utilizing the wristband. For instance, if a person has a relatively large wrist, only the first portion of the scored backing can be removed. Smaller wrists will entail removal of additional portions of the backing so that the wristband 16 can be adhesively secured around the wrist of the user of the tickets 18.

The portion or portions of the backing on the wristband 16 which are not intended to be easily removable to adjust the wristband may be relatively permanently secured to said wristband.

Therefore, when the owner of the kit 10 begins the utilization of the various resources of the amusement resort, he peels off the ticket which is appropriate to the ride on which he intends to embark. The encoded bar code 52 will be entered automatically into the computer system of the amusement park and indicates the utilization of that particular ticket so that a running account of the usage of the various rides can be maintained.

After all of the tickets 18 have been utilized, the individual wearing the wristband 16 and the badge or card 14 is precluded from using any of the other rides or repeating rides in the amusement resort.

Although the kit 10 components incorporate a representation of the use of the kit, the kit 10 can incorporate in the code 40 various other materials than a representation of the use of the kit 10, such as textual or other information in machine-readable form which is pertinent to the purchase or other aspects of the kit 10 and the tickets 18 provided thereupon.

Figure 3:
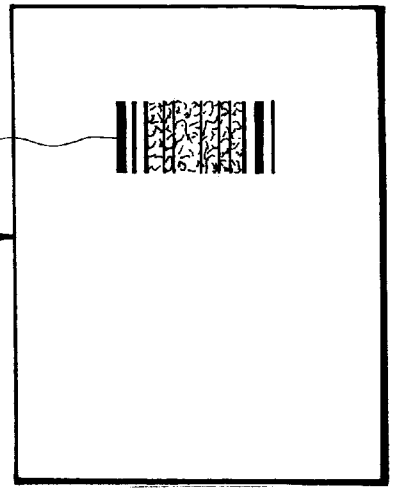
FIG. 3 is a rear view of the identification card or badge.
Figure 2:
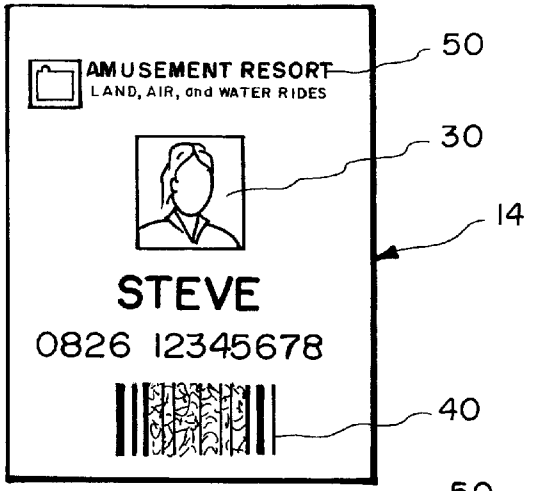
FIG. 2 is a front elevational view of the identification card or badge of the invention.
Figure 4:
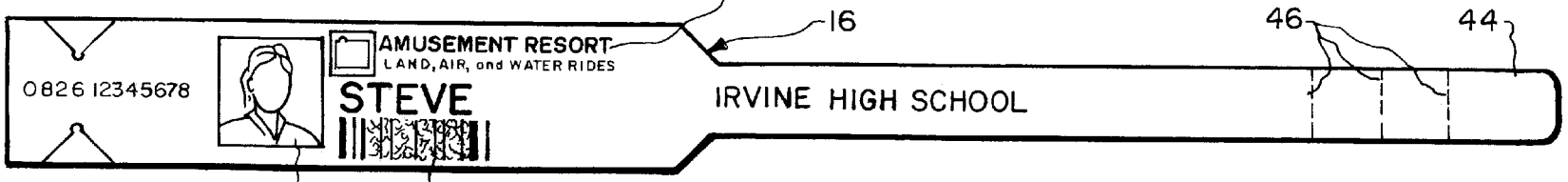
FIG. 4 is a plan view of an identification wristband incorporating the teachings of the invention.
Figure 5:
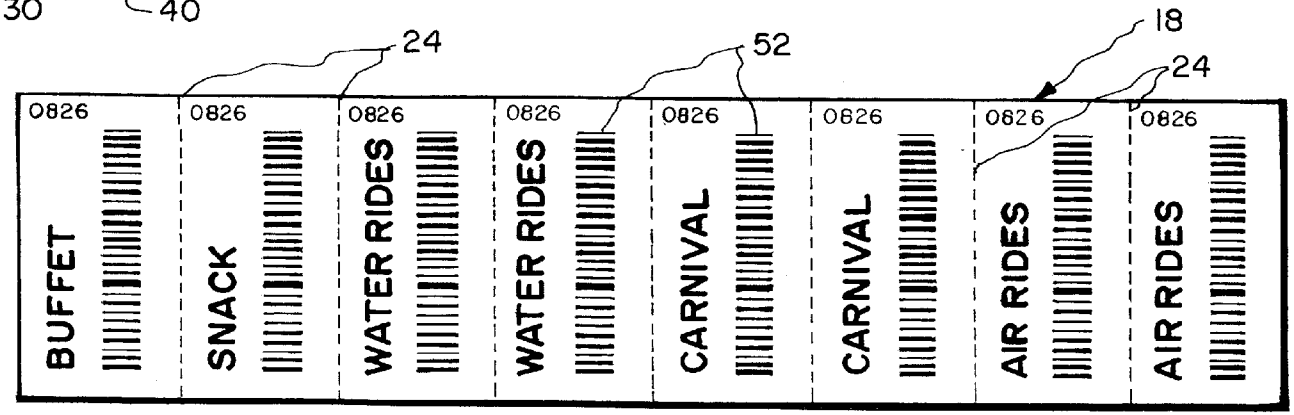
FIG. 5 is a view showing additional materials incorporated in the identification kit and capable of being utilized in conjunction with the card and/or wristband to establish the identity between the additional materials and the wearer of the wristband or the holder of the card.

Furthermore, although the card or badge 14 is shown as having a code 40 on one side thereof, excess material relating to or constituting a continuum of the code 40 may be applied or printed on the back of the card or badge 14 as illustrated in FIG. 3 of the drawings. Therefore, the reader can continue reading the additional coded material on the back of the card or badge 14 after the initial reading of the coded material on the front of the card 14. As previously mentioned, the portion or portions of the backing overlying the additional coded material on the back of the card 14 may be selectively peeled from said back.

In additional although the individual shown on the photographic or other image 30 is presented in front face on both the card 14 and wristband 16, a different image of the individual, such as a side view, may be presented facilitating the immediate comprehension of the appearance of the individual presenting the card 14 or wristband 16.

As previously mentioned, the image 30 is encoded and printed as bar code 40 on the card 14 and wristband 16. When the card is presented, the code 40 is scanned and decompressed but the original image may not be reproduced in identical fashion by reproduction of the image 30 on the scanning device. Therefore, the utilization of two different views may be indicated.

Of course, visually-readable materials 50 may be printed on the card 14 and wristband 16 for immediate visual apperception of the source and purpose of the individual elements of the kit 10.

As previously mentioned, the visual image on the card 14 and wristband 16 may be photographically or electronically generated. In electronic generation, a camera is utilized to feed a signal to a computer and a digital portrait of the subject may be displayed on a monitor associated with the computer. An image compression algorithm reduces the amount of data to store the image. Thus, compression of the image from the actual representation of the person being scanned will result in the alteration of the encoded image.

Computer software generates a machine-readable encoded version of the human recognizable data on the screen of the monitor. The encoded version is then printed on the card by a printer.

For verification, the card 16 is scanned by a computer or hand-held scanner which reads the encoded information 40 on the card 14. This information is transmitted from the scanner to the computer and, from this scanned encoded information, the photographic, graphical, or textual information originally encoded is approximately regenerated. However, there is a loss entailed in the identity of the original image, particularly where a photograph is applied to the card 14 and scanned by the computer.

Although the preferred embodiment of the invention shows the utilization of the card 14 and wristband 16 in a context where only one individual is involved, there are many applications of the kit 10 which include a significant linkage with another individual or with objects other than the individual whose image is displayed on the card 14 and/or wristband 16. Furthermore, the card 14 and wristband 16 need not display the same image. For instance, in a situation where a mother brings her child to a mall which provides an entertainment facility for the amusement of the child, the kit 10 can be generated in an entirely different manner or the components thereof can be generated separately from the kit as integers.

In utilizing the linkage aspect of the invention, a card (primary information means) may be generated which includes a visual image of the mother (primary information) and an encoded image of the child (secondary information means) or vice-versa. The child will have a wristband (secondary information means) installed on its wrist which has a visual image of the child (secondary information) and an encoded image of the mother or vice-versa.

Therefore, when either the wristband or the card are presented, the nexus between the mother and child can be established. Utilization of the card will cause the encoded image of the child and/or mother to appear thus verifying the mother/child relationship. Similarly, the wristband can be read to show the depiction of the mother and/or child and/or fingerprints in the encoded material.

Furthermore, the linkage aspect of the invention can be utilized as a verification means for the performance of certain requirements requisite to the entry into a particular area of a performance.

At the Grand Prix in Le Mans, France, a desirable location to view the race is in the center field. However, the center field location is also a dangerous location, since disabled vehicles may be projected across the center field causing injury to the spectators in that location. Consequently, the spectators are required to sign a release which is maintained in the computer files.

When the release is executed, a card having an image of the person signing the release is created, together with encoded material indicating the execution of the release by the individual who carries the card. The individual can also be provided with a wristband carrying an image and the encoded release.

When the individual approaches the center field entry, the card is read by a reader and confirms that the individual has signed this release and the linkage between the individual and the release is established.

Many other identity linkages can be implemented by the utilization of the kit or components of the kit disclosed hereinabove.

While we have disclosed the linkage identification kit and the individual components thereof in specific application, it will, of course, be obvious to those skilled in the art that many variants of the concept can be provided which will still fall within the scope of the invention.

We claim:

1. In an identification linkage system for establishing a nexus between discrete primary and secondary entities, the combination of: primary information means having primary information thereupon and secondary information thereupon; and secondary information means having secondary information thereupon, said secondary information means having primary information means thereupon to establish a nexus between said primary and secondary means, said primary and secondary information means relating to discrete primary and secondary entities in existence when said primary and secondary information means are prepared.

2. The system of claim 1 in which said primary information on said primary information means is eye-readable and said secondary information is machine-readable to establish said nexus between said primary information on said primary information means and said secondary information on said secondary information means.

3. The system of claim 2 in which said secondary information on said secondary information means is eye-readable and said primary information is machine-readable to establish said nexus between the eye-readable primary information of said first information means and said machinereadable primary information of said secondary information means.

4. The linkage information system of claim 1 in which said primary information means is an identification card and said primary information is an image of cardholder and said secondary information means is an identification wristband having an image of the wristband wearer thereupon.

5. The system of claim 4 in which said secondary information on said card is machine-readable and said primary information on said wristband is machine-readable.

6. The system of claim 5 in which said secondary machine-readable information on said card incorporates said primary information on said secondary information means and said primary machine-readable information on said wristband incorporates said eye-readable primary information on said card.

7. The system of claim 1 in which said primary and secondary information means are initially connected to each other to facilitate the conjoint use thereof by said primary and secondary entities.

8. The system of claim 1 wherein said first and second information means incorporate hospital patient identification information, said system including a first information means identification wristband applicable to the wrist of a hospital patient and incorporating primary and secondary patient information and said secondary information means having secondary identification information to create said nexus between said patient and various medications and services provided by said hospital.

9. In a method of establishing an identification linkage between discrete entities, the steps of: preparing a primary information identification card having primary information in the form of an image of the card-carrier thereupon; applying machine-readable secondary information to said card; providing a secondary information means wristband to be worn on the wrist of the card-carrying individual; applying secondary information on said wristband; and applying said primary information on said wristband in encoded form, said primary and secondary information means relating to discrete primary and secondary entities in existence when said primary and secondary information means are prepared.

10. In a method of establishing a nexus between discrete entities, the steps of: preparing primary information means incorporating an image of a primary entity; providing secondary, machine-readable information on said primary identification means; providing secondary information means incorporating an image of said secondary entity; applying machine-readable primary information to said secondary information means whereby the machine reading of said primary information means on said secondary information means will establish said nexus between said first and secondary entities, said primary and secondary information means relating to discrete primary and secondary entities in existence when said primary and secondary information means are prepared.

11. The method of claim 10 in which said card and said wristband are imprinted on a common substrate and are separable from each other for utilization by said primary and secondary entities.

* * * * *